US010378165B2

(12) United States Patent
Dyke et al.

(10) Patent No.: US 10,378,165 B2
(45) Date of Patent: Aug. 13, 2019

(54) GUARDRAIL CRASH ABSORBING ASSEMBLY

(71) Applicant: LINDSAY TRANSPORTATION SOLUTIONS, INC., Omaha, NE (US)

(72) Inventors: Gerrit A. Dyke, Stockton, CA (US); Jeffrey M. Thompson, Sacramento, CA (US); Daniel Paul Decayanan Loya, Elk Grove, CA (US); Alvaro E. Morales Flores, Vacaville (SV); Jason T. Lim, Stockton, CA (US); Scott G. Kroeker, Omaha, NE (US); Marco Anghileri, Milan (IT)

(73) Assignee: Lindsay Transportation Solutions, Inc., Rio Vista, CA (US)

( * ) Notice: Subject to any disclaimer, the term of this patent is extended or adjusted under 35 U.S.C. 154(b) by 298 days.

(21) Appl. No.: 15/420,748

(22) Filed: Jan. 31, 2017

(65) Prior Publication Data

US 2018/0216303 A1 Aug. 2, 2018

(51) Int. Cl.
*E01F 15/14* (2006.01)
*E01F 15/04* (2006.01)

(52) U.S. Cl.
CPC ..... *E01F 15/143* (2013.01); *E01F 15/0423* (2013.01)

(58) Field of Classification Search
CPC ..... E01F 15/143; E01F 15/0423
USPC ..... 256/13.1
See application file for complete search history.

(56) References Cited

U.S. PATENT DOCUMENTS

| | | | | |
|---|---|---|---|---|
| 5,022,782 | A | 6/1991 | Gertz et al. | |
| 5,851,005 | A | 12/1998 | Muller et al. | |
| 5,947,452 | A | 9/1999 | Albritton | |
| 6,022,003 | A | 2/2000 | Sicking et al. | |
| 6,173,943 | B1 | 1/2001 | Welch et al. | |
| 6,293,727 | B1 | 9/2001 | Albritton | |
| 6,505,820 | B2 | 1/2003 | Sicking et al. | |
| 6,536,965 | B2 | 3/2003 | Albritton | |
| 6,719,483 | B1 * | 4/2004 | Welandsson | E01F 15/0476 256/13.1 |
| 7,059,590 | B2 | 6/2006 | Bronstad | |
| 7,101,111 | B2 | 9/2006 | Albritton | |
| 7,111,827 | B2 | 9/2006 | Sicking et al. | |
| 7,210,874 | B2 | 5/2007 | Albritton | |
| 7,243,908 | B2 * | 7/2007 | Alberson | E01F 15/143 256/13.1 |
| 7,306,397 | B2 * | 12/2007 | Albritton | E01F 15/0423 404/6 |
| 7,516,945 | B2 | 4/2009 | Alberson et al. | |
| 7,699,293 | B2 | 4/2010 | James | |
| 7,926,790 | B2 | 4/2011 | James | |

(Continued)

FOREIGN PATENT DOCUMENTS

KR 1020150111765 A 10/2015

*Primary Examiner* — Joshua T Kennedy
(74) *Attorney, Agent, or Firm* — Thomas R. Lampe

(57) ABSTRACT

A guardrail crash absorbing assembly including overlapping elongated upstream and downstream rail panels, an impact head for sliding an upstream rail panel relative to a downstream panel when impacted by a vehicle, and a cutting tooth with a cutting tooth portion having a cutting surface and a hook structure for cutting and splitting the downstream rail panel upon vehicle impact on the impact head.

17 Claims, 6 Drawing Sheets

(56) References Cited

U.S. PATENT DOCUMENTS

| | | | | |
|---|---|---|---|---|
| 8,215,619 | B2 * | 7/2012 | Leonhardt | E01F 15/025 256/13.1 |
| 8,360,400 | B2 | 1/2013 | Leonhardt et al. | |
| 8,424,849 | B2 * | 4/2013 | James | E01F 15/025 256/13.1 |
| 8,491,216 | B2 | 7/2013 | Dyke et al. | |
| 8,596,617 | B2 | 12/2013 | James | |
| 9,611,601 | B1 * | 4/2017 | Anghileri | E01F 15/04 |
| 2006/0011900 | A1 | 1/2006 | Ochoa | |
| 2006/0193688 | A1 * | 8/2006 | Albritton | E01F 15/146 404/6 |
| 2007/0252124 | A1 | 11/2007 | Heimbecker | |

* cited by examiner

GUARDRAIL CRASH ABSORBING ASSEMBLY

TECHNICAL FIELD

This invention is in the field of guardrail end terminals or crash cushions and relates to apparatus for absorbing energy when impacted by a vehicle. More specifically, the apparatus relates to a guardrail crash absorbing assembly utilized as a barrier which dissipates the energy caused by impact of a moving vehicle impacting the assembly.

BACKGROUND OF THE INVENTION

It is well known to provide impact absorbing systems, often called "crash attenuators" or "crash cushions" in association with guardrails. The guardrails may be disposed along roadways or utilized adjacent to rigid structures such as pillars, bridge abutments, lighting poles and the like for the purpose of absorbing vehicle impact energy and minimizing the effects of impact on the vehicle, vehicle occupants and any ancillary structure being shielded.

There are many forms and types of energy absorbing barriers. The following patents are believed to be representative of a variety of crash attenuator systems including patents disclosing such systems on or in connection with guardrails employing a plurality of overlapping side panels which are relatively movable and telescope in the event of a vehicle collision with the crash attenuator system: U.S. Pat. No. 8,596,617, issued Dec. 3, 2013, U.S. Pat. No. 8,491,216, issued Jul. 23, 2013, U.S. Pat. No. 7,926,790, issued Apr. 19, 2011, U.S. Pat. No. 5,022,782, issued Jun. 11, 1998, U.S. Pat. No. 5,851,005, issued Dec. 22, 1998, U.S. Pat. No. 7,699,293, issued Apr. 20, 2010, U.S. Pat. No. 8,360,400, issued Jan. 29, 2013, U.S. Pat. No. 7,516,945, issued Apr. 14, 2009, U.S. Pat. No. 7,059,590, issued Jun. 13, 2006, U.S. Pat. No. 6,173,943, issued Jan. 16, 2001, U.S. Pat. No. 6,022,003, issued Feb. 8, 2000, U.S. Pat. No. 5,947,452, issued Sep. 7, 1999, U.S. Pat. No. 7,111,827, issued Sep. 26, 2006, U.S. Pat. No. 7,210,874, issued May 1, 2007, U.S. Pat. No. 7,101,111, issued Sep. 5, 2006, U.S. Pat. No. 6,536,985, issued Mar. 25, 2003, U.S. Pat. No. 6,505,820, issued Jan. 14, 2003, U.S. Pat. No. 6,293,727, issued Sep. 25, 2001, U.S. Patent App. Pub. No. US 2006/0011900, published Jan. 19, 2006, U.S. Patent App. Pub. No. US 2006/0193688, published Aug. 31, 2006, U.S. Patent App. Pub. No. US 2007/0252124, published Nov. 1, 2007, and Korean Patent No. KR102015011765A, issued Oct. 6, 2015.

As will be seen below, the present invention incorporates sliding structure of a distinctive character in operative association with overlapping rail panels of a crash absorbing guardrail panel assembly.

The use of sliders per se is generally known in the crash absorbing guardrail art, but the structural combination and manner of operation of the present invention differ considerably from such known impact slider arrangements.

DISCLOSURE OF INVENTION

The present invention relates to a guardrail crash absorbing assembly.

The assembly includes an elongated upstream rail panel having an upstream rail panel front portion and an upstream rail panel rear portion. An elongated downstream rail panel having a downstream rail panel front portion and a downstream rail panel rear portion is provided. The upstream rail panel rear portion and the downstream rail panel front portion are in side by side, overlapping relationship forming a panel joint.

An impact head structure is operatively associated with the upstream rail panel and responsive to vehicle impact on the impact head structure to move the upstream rail panel rearwardly lengthwise along the downstream rail panel.

A braking structure is provided for dissipating kinetic energy of the upstream rail panel sliding along the downstream rail panel and absorbing impact forces caused by vehicle impact on the impact head structure.

Other features, advantages and objects of the present invention will become apparent with reference to the following description and accompanying drawings.

BEST MODE FOR CARRYING OUT THE INVENTION

Figure 1:
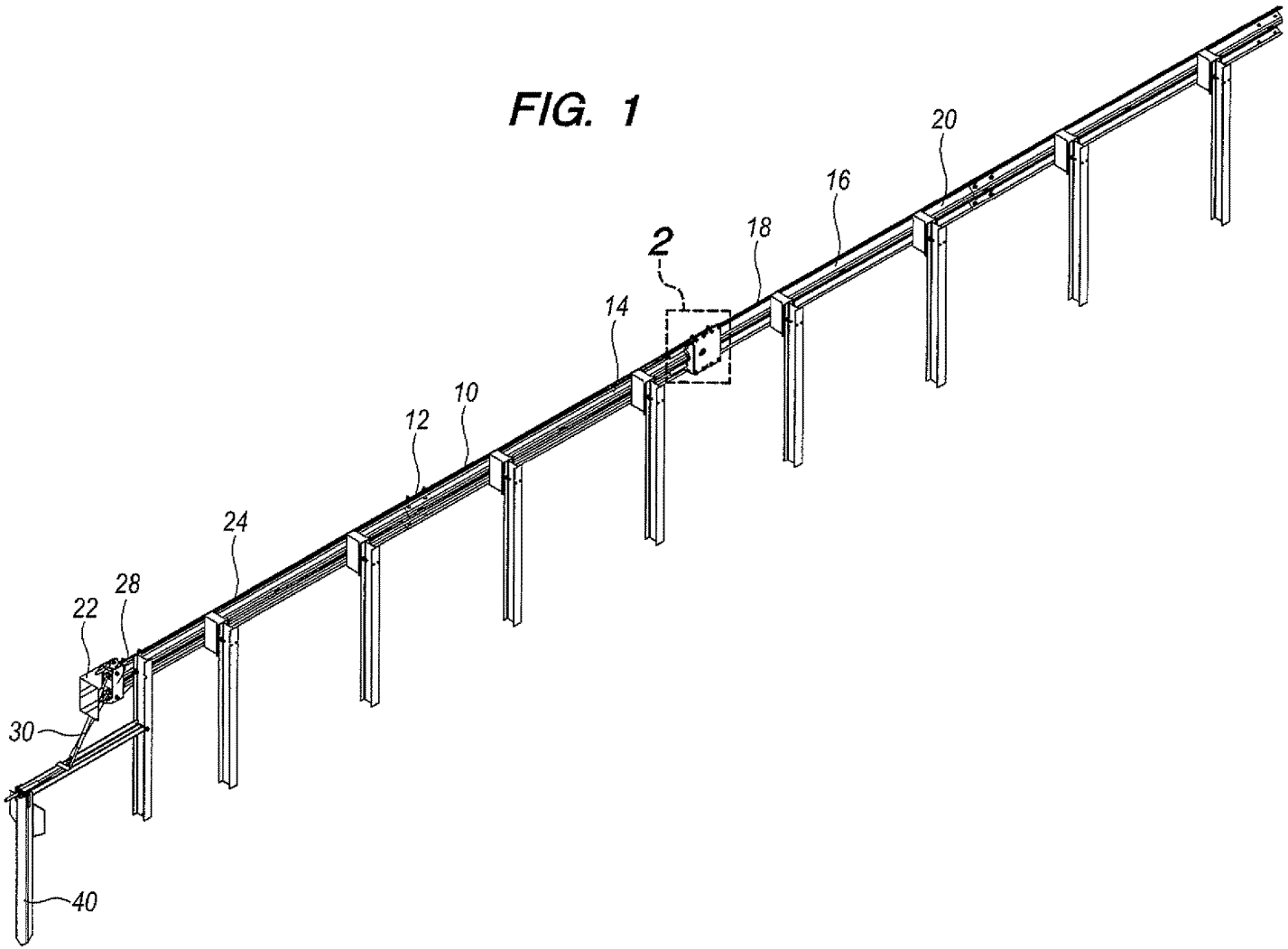
FIG. 1 is a perspective view of the guardrail crash absorbing assembly.
Figure 2:
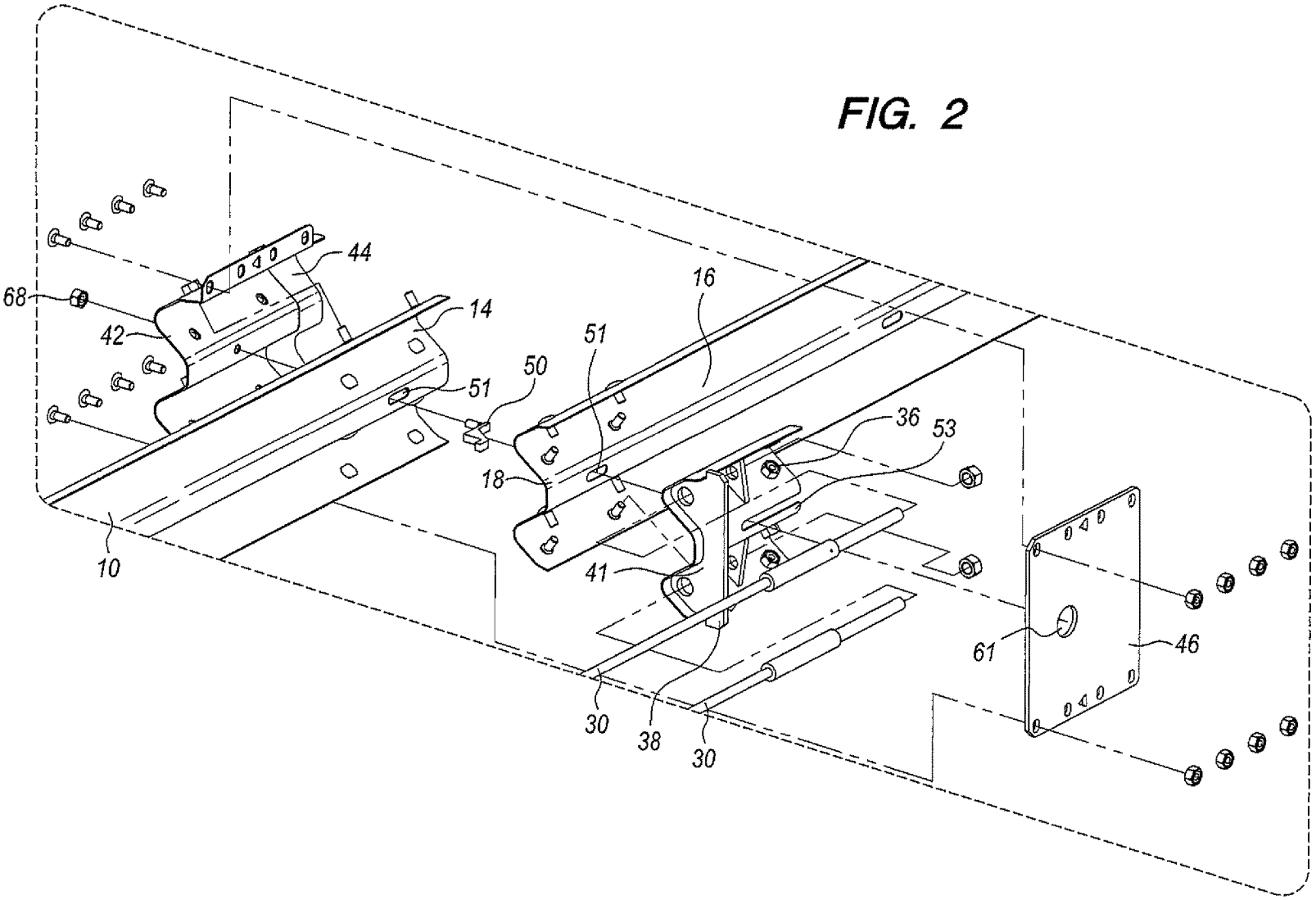
FIG. 2 is an enlarged, exploded view illustrating structural components of the assembly located at a panel joint.
Figure 3:
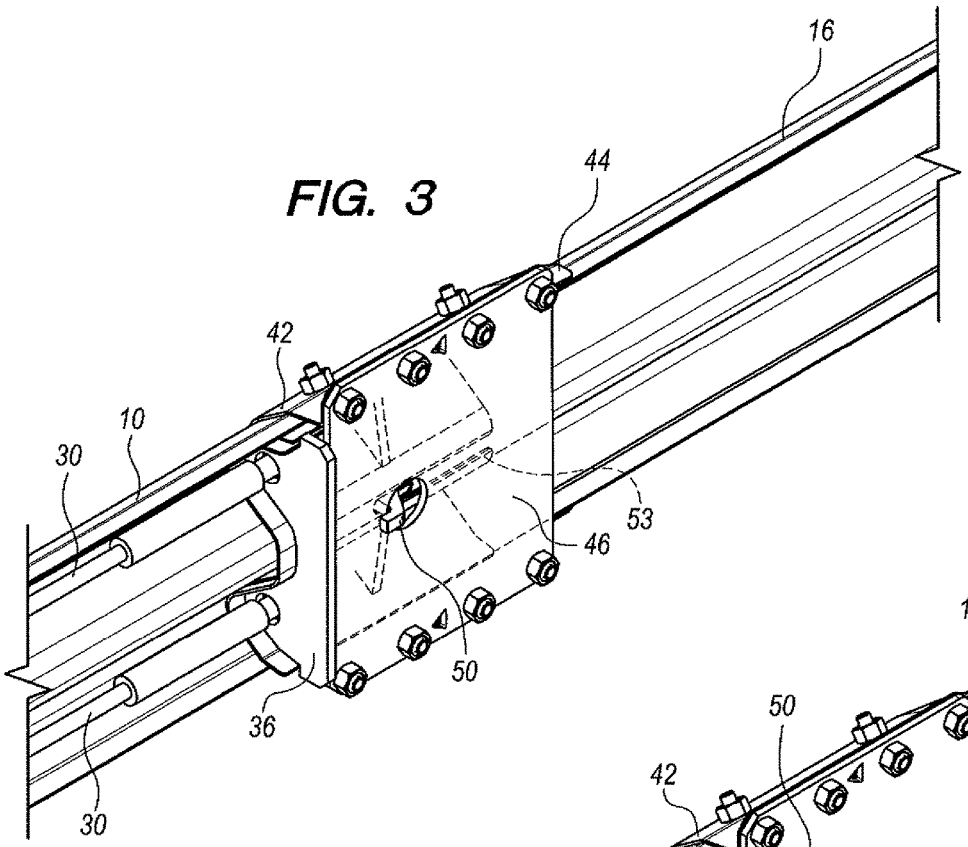
FIG. 3 is an enlarged, perspective view of structural components of the assembly illustrating their relative positions when there is no vehicle impact.

Referring now to the drawings, a guardrail crash absorbing assembly constructed in accordance with the present invention includes an elongated upstream rail panel 10 having an upstream rail panel front portion 12 and an upstream rail panel rear portion 14.

The assembly further includes an elongated downstream rail panel 16 having a downstream rail panel front portion 18 and a downstream rear panel rear portion 20. The upstream rail panel rear portion and the downstream rail panel front portion are in side by side, overlapping relationship at a panel joint.

The assembly includes an impact head 22 which is connected to elongated upstream end panel 10 by an intermediate guardrail member or section 24 and a mounting bracket 26.

The impact head also includes a housing 28 affixed to the mounting bracket, the housing defining openings at the front and back (not shown) through which tension cables 30 extend. The tension cables are affixed to a ground anchor 40.

Any suitable means may be employed to control and allow slidable movement of the impact head along the tension cables in response to a frontal vehicle impact on the impact head to provide absorption of energy caused by the crash. One such suitable structure for doing this would be friction bar (not shown) with holes through which the tension cables 30 pass. When the friction bar is twisted, it forces the cables into a distorted position. The friction caused by this distortion and tortuous cable path dissipates a significant amount of energy as the impact head is forced along the cables during a crash. The features relating to the type of impact head 22 and to the friction bar are known and do not form part of the present invention.

The impact head 22 is operatively associated with the elongated upstream rail panel and is responsive to vehicle impact on the impact head to move the upstream rail panel 10 rearwardly lengthwise along the downstream rail panel 16. The tension cables extend from the ground anchor 40 and anchored at the front end of the panel 16.

Braking structure is provided for dissipating kinetic energy generated by the upstream rail panel sliding along the downstream rail panel and absorb impact forces caused by vehicle impact on the impact head structure.

The braking structure includes friction slider structure at the panel joint. The friction slider structure includes an inside slider 36 mounted to the inside of the downstream guardrail panel 16 at the panel joint.

The inside slider 36 includes a bracket 38 receiving and retaining the downstream ends of tension cables 30, the leading or upstream ends of the cables anchored to the ground in front of the impact head 22 as previously described. The inside slider also includes a tension plate 41, the purpose of which will be described below.

The friction slider of the invention additionally includes a traffic side slider 42 attached to the upstream rail panel 10 at front portion 12 for restricting the upstream rail panel and downstream rail panel from flaring into traffic. The traffic side slider 42 includes a sloped traffic slider rear section 44 for preventing vehicles from snagging on a lip of the upstream rail panel during a reverse vehicle impact.

A rear side slider 46 is fixedly mounted to the traffic side slider 42 by bolts both above and below rail panels 10, 16.

The guardrail is supported by spaced support posts in a conventional manner. Blackouts formed of wood or other suitable material are located between the posts and guardrail. The rear side slider 46 is operable to break the rail support post blockouts or the blackout connection to the rail during head-on impact, increase stability at the panel joint and prevent spearing of an impacting vehicle. Furthermore, the rear side slider 46 is operable to prevent separation of the upstream rail panel, downstream rail panel and friction slider at the panel joint during a redirective vehicle impact on the guardrail crash absorbing assembly.

An extremely important aspect of the present invention is cutting tooth 50 located at the panel joint and operatively associated with the friction slider structure for cutting and splitting downstream rail panel 16 responsive to vehicle impact on the impact head structure. Cutting tooth 50 is mounted on the traffic side slider 42 and extends through slots 51 in the upstream rail panel 10 and the downstream rail panel 16 at the friction joint and an open ended slot 53 in the inside slider 36. These slots may be the standard slots provided with standard guardrail sections or not standard slots.

The cutting tooth 50 includes a cutting tooth portion 52 having a cutting structure 54 and a hook structure 56. The cutting tooth portion projects through the slots 51 formed in the upstream rail panel and the downstream rail panel at the panel joint. The cutting tooth portion also projects through an open ended slot 53 in the inside slider and passes through a hole 61 formed in rear side slider 46. The hook structure hooks onto the rear side slider where the rail panels overlap.

Figure 8:
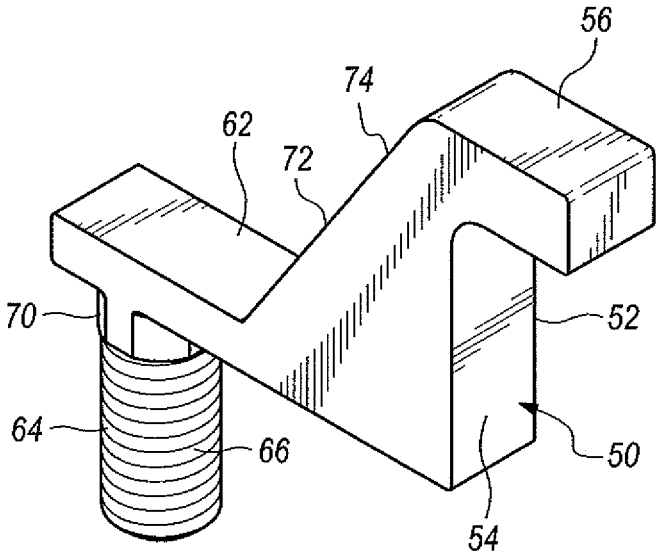
FIG. 8 is a perspective view of a cutting tooth of the invention.

With particular reference to FIG. 8, cutting tooth 50 additionally includes a cutting tooth mounting portion including a base 62 positioned between the rail panels 10, 16 and between the traffic side slider 34 and the inside slider 36. The cutting tooth mounting portion also includes a stud 64 having a threaded end portion 66. The threaded end portion 66 is connected to the traffic side slider by a nut 68 applied to the threaded end portion.

The mounting stud 64 includes a shoulder portion 70 between the base and the threaded portion for preventing overtightening of the threaded fastener and allowing the cutting tooth to operate as a caster. The caster maintains the alignment of the braking force normal to the impacting force of a vehicle.

The cutting structure 54 has a cutting surface 72 which extends at an angle from the base to the hook structure and the cutting surface 72 and the hook structure are offset from the mounting stud. The cutting tooth cutting surface 54 is defined by spaced, parallel cutting edges 74, only one of which is visible in FIG. 8.

With the hook portion hooking onto the rear side slider, the cutting tooth 50 acts to "pin" the panel joint structural components in place prior to impact of a vehicle on the impact head. The offset feature of the tooth is the sole means for maintaining the overlap of the upstream rail panel and downstream rail panel at the joint, no permanent fasteners securing them in place.

The joint will be maintained by the tooth when there is a side impact by a vehicle and support for redirecting the vehicle in that situation will be maintained.

As indicated above, the inside slider mounted to the inside of the downstream rail also functions as a tensioner. During a redirective impact, the inside slider tension plate 41 catches on the rear side slider to prevent system separation/bifurcation at the panel joint, a feature crucial to proper system performance. The backside of the tooth provides longitudinal restriction.

In the situation where impact on the impact head structure takes place, the hook will be moved remain engaged with the rear side slider, and during sliding movement between the rail panels form a cut in the downstream rail panel, splitting the downstream panel during movement due to compressive cutting forces and absorb kinetic energy. This action removes energy from the system and also serves to weaken the downstream rail, reducing the risk of vehicle spearing.

The cutting tooth 50 includes a flat vertical face 75 and the clamping action of the slider structure keeps the tooth engaged when the panels are put in tension (redirect hit). The hook structure keeps the tooth engaged at the proper position and angle during the cutting process and prevents the tooth from rotating and disengaging from the cutting portion.

Figure 4:
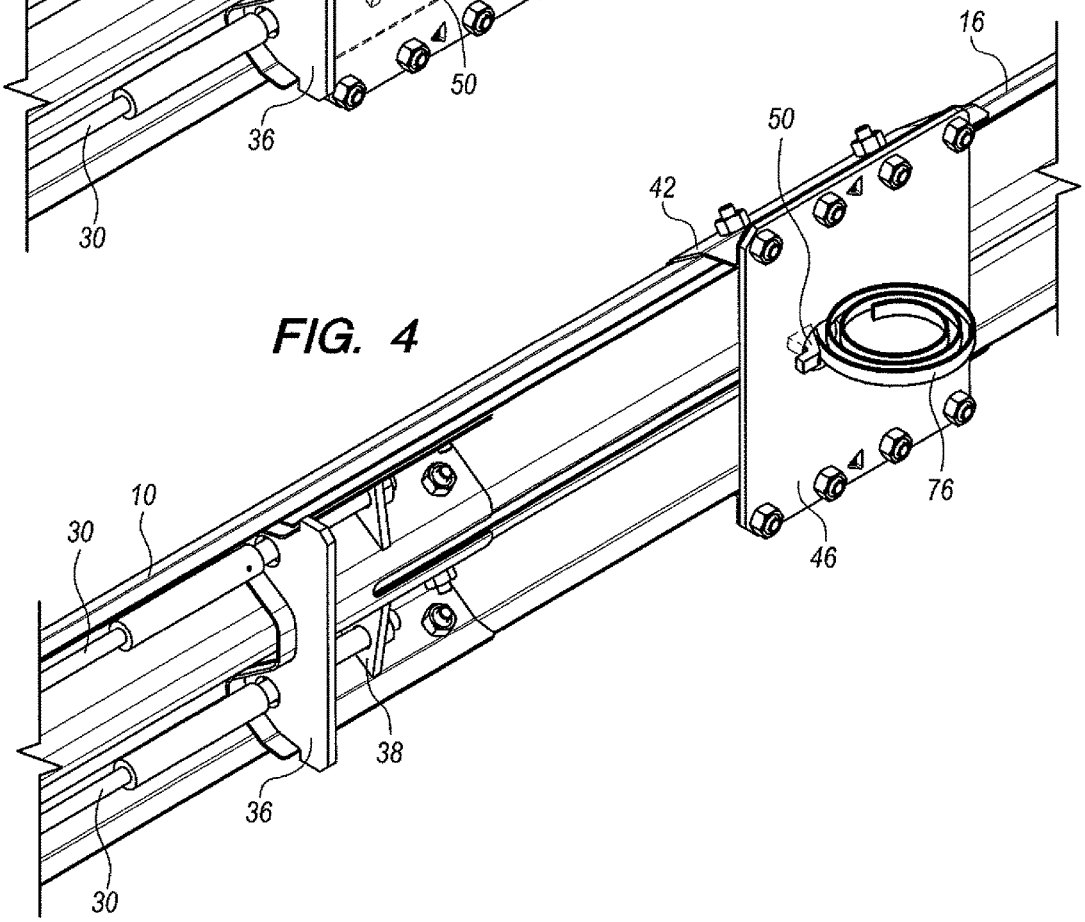
FIG. 4 is a view similar to FIG. 3, but illustrating relative positions of the structural components after vehicle impact.
Figure 5:
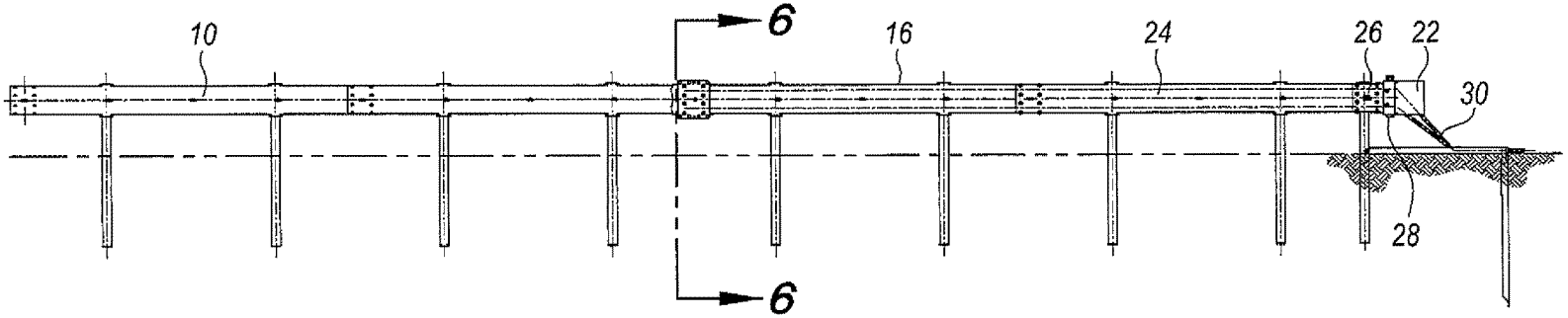
FIG. 5 is a side elevation view of the assembly prior to vehicle impact on the guardrail impact head.
Figure 6:
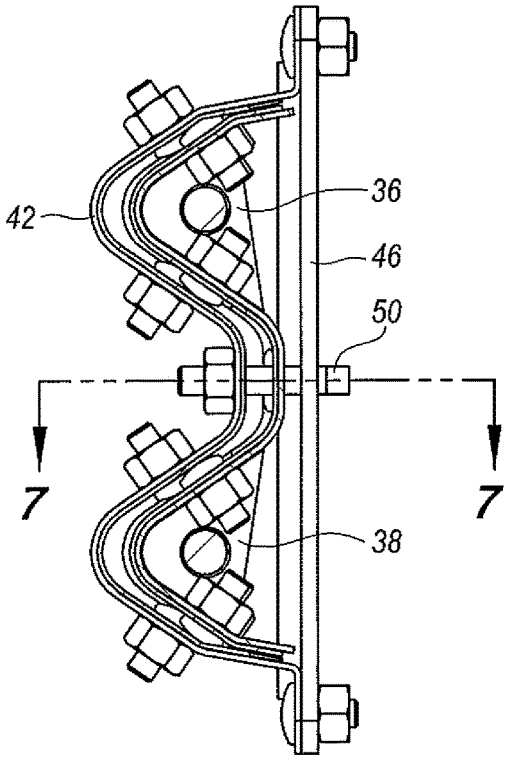
FIG. 6 is an enlarged, cross-sectional view taken along line 6-6 of FIG. 5.
Figure 7:
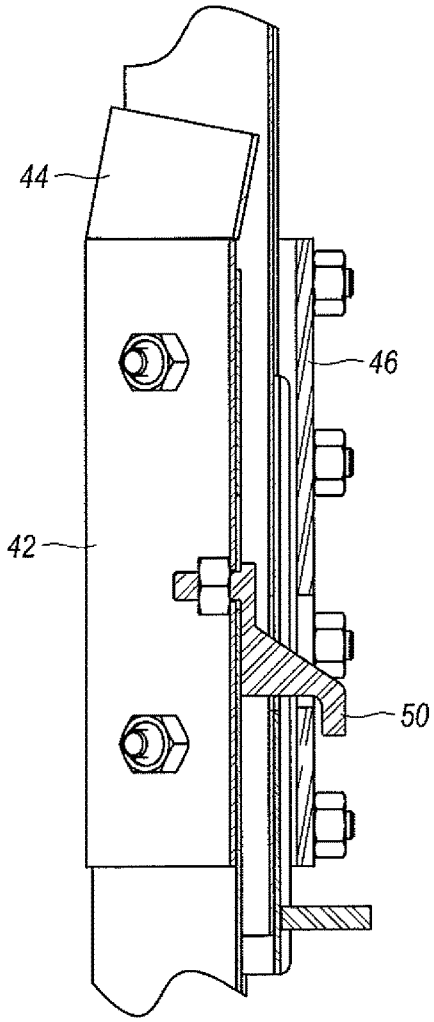
FIG. 7 is a greatly enlarged, cross-sectional view taken along line 7-7 of FIG. 6.

The tooth configuration results in the removal of a strip 76 of the downstream rail panel that will coil away from the coupling system (in a coiled strip) and not cause interference. See FIG. 4. The alternative would be to have a "tooth" that cuts and upsets the guardrail section, in the cutting process, and creates interference between the coupler and the deformed rail section, which is not desirable. It is to be noted that the angle of the cutting surface and the offset feature of the hook result in cutting without fouling.

More than one tooth may be employed in the assembly when practicing the present invention. Furthermore, although the invention may be practiced utilizing one or more tension cables, or for that matter no tension cables at all, use of one or more tension cables is preferred since such feature will not only contribute to absorption of crash energy but also add to the redirective capacity of the system.

The invention claimed is:

1. A guardrail crash absorbing assembly comprising:

an elongated upstream rail panel having an upstream rail panel front portion and an upstream rail panel rear portion;

an elongated downstream rail panel having a downstream rail panel front portion and a downstream rail panel rear portion, said upstream rail panel rear portion and said downstream rail panel front portion being in side by side, overlapping relationship at a panel joint;

an impact head structure operatively associated with said upstream rail panel and responsive to vehicle impact on the impact head structure to move said upstream rail panel rearwardly lengthwise along said downstream rail panel; and a braking structure for dissipating kinetic energy of said upstream rail panel sliding along the downstream rail panel and absorb impact forces caused by vehicle impact on said impact head structure, said braking structure including friction slider structure at said panel joint and at least one cutting tooth located at said panel joint operatively associated with said friction slider structure for cutting and splitting said downstream rail panel responsive to vehicle impact on said impact head structure, said friction slider structure including a traffic side slider attached to said upstream rail panel for restricting the upstream rail panel and downstream rail panel to prevent flaring thereof into traffic and an inside slider mounted to the inside of the downstream rail panel; and said cutting tooth including a cutting tooth portion having a cutting surface and a hook structure, the cutting tooth portion projecting through slots formed in said upstream rail panel and said downstream rail panel at said panel joint.

2. The guardrail crash absorbing assembly according to claim 1 wherein said cutting tooth additionally includes a cutting tooth mounting portion including a base positioned between said traffic side slider and said inside slider and a mounting stud connected to said traffic side slider.

3. The guardrail crash absorbing assembly of claim 2 wherein said mounting stud has a threaded end portion connected to said traffic side slider by a threaded fastener.

4. The guardrail crash absorbing assembly according to claim 3 wherein said mounting stud includes a shoulder portion between said base and said threaded portion for preventing over tightening of said threaded fastener and allowing the cutting tooth to operate as a caster.

5. The guardrail crash absorbing assembly according to claim 4 wherein said cutting surface extends at an angle from the base to said hook structure.

6. The guardrail crash absorbing assembly according to claim 5 wherein the cutting surface and said hook structure are offset from the mounting stud.

7. The guardrail crash absorbing assembly according to claim 1 wherein said traffic side slider includes a sloped rear section for preventing vehicles from snagging on a lip of the upstream rail panel during a reverse vehicle impact.

8. The guardrail crash absorbing assembly according to claim 1 additionally including at least one tension cable and wherein said inside slider includes a bracket structure receiving and retaining said at least one tension cable.

9. The guardrail crash absorbing assembly according to claim 1 additionally including a rear side slider mounted to the traffic side slider, said hook structure hooking onto said rear side slider.

10. The guardrail crash absorbing assembly according to claim 9 wherein said rear side slider defines an opening through which said cutting tooth portion projects.

11. The guardrail crash absorbing assembly according to claim 9 wherein support posts having blockouts support the rail panels, the rear side slider operable to break one or more of the blackouts or the blackout connection to the rail during head-on impact, increase stability at the panel joint and prevent spearing of an impacting vehicle.

12. The guardrail crash absorbing assembly according to claim 10 wherein said rear side slider is cooperable with said cutting tooth and said inside slider to prevent separation of the upstream rail panel, downstream rail panel and friction slider at the panel joint during a redirective vehicle impact on the guardrail crash absorbing assembly.

13. The guardrail crash absorbing assembly according to claim 1 wherein said cutting tooth cutting surface is defined by spaced parallel cutting edges resulting in a shear cut formation of a continuous strip from said downstream rail panel.

14. The guardrail crash absorbing assembly according to claim 13 wherein said cutting tooth is configured to form said continuous strip into a coiled configuration.

15. A guardrail panel cutting tooth for forming a longitudinal cut in a guardrail panel by applying compressive shearing forces to the guardrail panel, said guardrail panel cutting tooth comprising:

a cutting tooth portion having a cutting surface and hook structure; and a cutting tooth mounting portion including a base, said cutting surface extending outwardly at an angle from the base to said hook structure, said tooth cutting surface defined by two spaced parallel cutting edges for shear cutting a continuous strip from said guardrail panel when pressure is exerted on the guardrail panel by said cutting tooth, said tooth configured to form said strip into a coiled configuration, and said cutting surface and said hook structure offset relative to said base, said mounting portion including a mounting stud projecting from said base in a direction generally opposed to the cutting tooth portion and having a threaded end portion.

16. The guardrail panel cutting tooth according to claim 15 wherein said mounting stud includes a shoulder portion between said base and said threaded portion for preventing over tightening of said threaded fastener and allowing the cutting tooth to operate as a caster.

17. The guardrail crash absorbing assembly according to claim 15 wherein the cutting surface and said hook structure are offset from the mounting stud.

* * * * *